US006743354B1

(12) United States Patent
Evans, Jr. et al.

(10) Patent No.: US 6,743,354 B1
(45) Date of Patent: Jun. 1, 2004

(54) DRAIN GUARD CATCH BASIN

(75) Inventors: R. Douglas Evans, Jr., Bedford County, PA (US); Matthew J. Huff, Blair County, PA (US); Robert J. Starr, Blair County, PA (US)

(73) Assignee: New Pig Corporation, Tipton, PA (US)

( * ) Notice: Subject to any disclaimer, the term of this patent is extended or adjusted under 35 U.S.C. 154(b) by 38 days.

(21) Appl. No.: 10/097,333

(22) Filed: Mar. 14, 2002

Related U.S. Application Data

(60) Provisional application No. 60/280,060, filed on Mar. 30, 2001.

(51) Int. Cl.[7] ..... E03F 5/06

(52) U.S. Cl. ..... 210/164; 210/170; 210/305; 210/532.1; 210/307; 404/4

(58) Field of Search ..... 210/163, 164, 210/170, 429, 532.1, 305, 307; 404/4, 5

(56) References Cited

U.S. PATENT DOCUMENTS

| | | | | | |
|---|---|---|---|---|---|
| 414,240 | A | * | 11/1889 | Norton | 210/163 |
| 1,507,531 | A | * | 9/1924 | Vaudell | 210/164 |
| 2,246,390 | A | | 6/1941 | Smith | |
| 4,136,010 | A | | 1/1979 | Pilie et al. | |
| 4,650,365 | A | | 3/1987 | Runnels | |
| 5,383,745 | A | | 1/1995 | Shannon | |
| 5,569,372 | A | | 10/1996 | Smith | |
| 5,582,720 | A | * | 12/1996 | Deming | 210/164 |
| 5,650,065 | A | * | 7/1997 | Sewell | 210/163 |
| 5,925,242 | A | * | 7/1999 | McGhee | 210/164 |
| 6,217,757 | B1 | * | 4/2001 | Fleischmann | 210/163 |
| 6,406,620 | B1 | * | 6/2002 | Rogers | 210/163 |

* cited by examiner

*Primary Examiner*—Christopher Upton
(74) *Attorney, Agent, or Firm*—Buchanan Ingersoll PC

(57) ABSTRACT

A catch basin is provided for insertion into a pre-existing storm drain connected to a storm drain system, the storm drain having a shoulder around its upper periphery for supporting a pre-existing, perforated storm drain cover. The catch basin selectively controls the flow of liquids and viscous materials into the storm drain system, and includes a flexible, fluid impermeable container extendable into the storm drain with its edges extendable over the storm drain shoulder about the periphery thereof. The flexible, fluid impermeable container includes a drain hole providing an outlet to the storm drain system. A rigid valve member is attached to the flexible, fluid impermeable container and is configured to selectively open and close the drain hole. The rigid valve member includes a vertically extending wall surrounding the drain hole and extending upward therefrom a distance h to define an opening. With the drain hole open, liquid accumulating in the flexible, fluid impermeable container will not pass through the drain hole until the liquid rises to a level exceeding the height h of the vertically extending walls surrounding the drain hole. The catch basin further includes a plurality of vertically extending leg members attached to the rigid valve member, with each of the plurality of vertically extending leg members having a horizontally extending flange engagable the storm drain shoulder on top of the flexible, fluid impermeable container to maintain the catch basin within the storm drain.

23 Claims, 6 Drawing Sheets

DRAIN GUARD CATCH BASIN

CROSS-REFERENCE TO RELATED APPLICATIONS

This application claims the benefit of provisional Patent Application Serial No. 60/280,060 entitled "Drain Guard Catch Basin", filed on Mar. 30, 2001, the entire disclosure of which is incorporated by reference herein.

FIELD OF THE INVENTION

The present invention is directed toward a catch basin structure for storm drains to prevent unwanted liquids from entering a storm drain system and, more particularly, toward a catch basin structure for storm drains adjustable to fit different size storm drains to prevent unwanted liquids, and also unwanted debris, from entering a storm drain system.

BACKGROUND OF THE INVENTION

Storm drains are typically installed at locations convenient to collect rain water, or other moisture, such as melting snow, etc., and direct the collected rain water underground to a river, stream, creek, lake, bay, retention pond, or other body of water. While storm drains serve a useful purpose in that they prevent the accumulation of standing water which may cause a variety of problems in both industrial and residential settings, adverse consequences may result when storm drains are located near areas where hazardous materials are being handled or stored. If these hazardous materials should spill, leak, or otherwise accidentally discharge into the storm drain, which ultimately empties into a river, stream, lake, etc., the financial costs associated with containing and/or cleaning up the spill may be enormous. Further, the adverse impact such contamination may have on the environment may be incalculable.

Companies have utilized various methods to prevent hazardous materials from spilling or leaking into storm drains. One such method has been to either cover or surround the storm drain with absorbent articles, such as, blankets, socks, booms, etc. Another method that has been utilized is to surround the storm drain with mounds of absorbent loose, material. Either of these methods may be implemented before a spill occurs as a preventive measure, or afterwards to minimize the amount of hazardous material entering the storm drain, and thus the damage caused by the spill. While the above methods perform adequately for spill containment, they include various drawbacks.

When absorbent articles (blankets, socks, booms, etc.) are utilized to contain a spill of hazardous liquid, or other viscous material, they are often required to be held down by a heavy object(s). The movement and placement of such heavy objects is time consuming and may permit unwanted hazardous material to flow into the storm drain when such absorbent articles are implemented in an emergency situation after a spill has occurred. Further, the use of a heavy object(s) will not always prevent hazardous materials from flowing underneath the edges of the absorbent article and into the storm drain. Additionally, once absorbent articles have become saturated, they must be removed since they will no longer exhibit absorbent properties. During removal and replacement of the absorbent articles, unwanted hazardous materials may flow into the storm drain.

When mounds of loose, absorbent materials are utilized for spill clean-up purposes, they typically need to be cleaned up immediately after the spill is contained. Otherwise, an unsightly and potentially dangerous situation may result.

Further, if left outside after being used to contain a spill of hazardous materials, rain water can cause the absorbent materials, with the absorbed hazardous material, to wash down the storm drain. Also, if the spill is large enough, the spill itself may cause loose particles of the absorbent material to wash down the storm drain.

Additionally, there is a limit to the absorbent properties of the absorbent materials and, once saturated, they must be removed and replaced with new absorbent materials to adequately contain the spill. Similar to the absorbent articles, unwanted hazardous materials may flow into the storm drain during removal and replacement of the loose absorbent materials.

Since both the absorbent articles (blankets, socks, booms, etc.) and the containers including the loose, absorbent material are bulky, it may be such that certain settings do not permit the absorbent articles and/or containers of loose absorbent material to be situated close to the storm drain. Time is typically of the essence in a hazardous material spill situation, and the time lost in obtaining and utilizing the absorbent articles and/or containers of loose absorbent material to contain the spill may allow unwanted hazardous materials to flow into the storm drain.

In an effort to overcome the above-identified drawbacks, catch basin structures have been developed which physically reside in the storm drain. These catch basin structures typically include a drain outlet and a plug-type element which may be utilized to close the drain outlet in the event of a hazardous material spill, in an attempt to maintain the hazardous material within the catch basin structure. However, since the prior art catch basin structures are typically designed to have their drain outlets at a lower most portion of the structure, it may not be possible to avoid entirely the ingress of the initial flow of the hazardous material into the storm drain in an emergency spill situation. Further, should trash, debris, or other solid material enter the prior art catch basin structures, they may clog the drain outlet, preventing the insertion or actuation of the plug type element to close the catch basin structure. In a situation where a hazardous material spill is trying to be contained, the financial and environmental loss associated with the inability to close the catch basin structure due to the clogged trash or debris may be enormous.

The present invention is directed toward overcoming one or more of the above-mentioned problems.

SUMMARY OF THE INVENTION

A catch basin is provided for insertion into a pre-existing storm drain connected to a storm drain system, the storm drain having a shoulder around its upper periphery for supporting a pre-existing, perforated storm drain cover. The catch basin selectively controls the flow of liquids and other viscous materials into the storm drain system, and includes a flexible, fluid impermeable container extendable into the storm drain with its edges extendable over the storm drain shoulder about the periphery thereof. The flexible, fluid impermeable container includes a drain hole providing an outlet to the storm drain system. A rigid valve member is attached to the flexible, fluid impermeable container and is configured to selectively open and close the drain hole. The rigid valve member includes a vertically extending wall surrounding the drain hole and extending upward therefrom a distance h to define an opening. With the drain hole open, liquids accumulating in the flexible, fluid impermeable container will not pass through the drain hole until the liquid rises to a level exceeding the height h of the vertically extending walls surrounding the drain hole. The catch basin thus acts as a debris catcher with the vertically extending wall functioning as a weir to regulate the flow of liquid through the storm drain. The catch basin further includes a plurality of vertically extending leg members attached to the rigid valve member, with each of the plurality of vertically extending leg members having a horizontally extending flange engagable with the storm drain shoulder on top of the flexible, fluid impermeable container to maintain the catch basin within the storm drain. Typically, a sealant is provided between the storm drain shoulder and the flexible container to effectuate a water-tight seal therebetween.

In a preferred form, the rigid valve member includes a first plate having a hole corresponding to the drain hole in the flexible, fluid impermeable container. The vertically extending wall extends from a top surface of the first plate and surrounds the hole therein. The flexible, fluid impermeable container is attached to the first plate such that the drain hole and the hole in the first plate are aligned.

The rigid valve member may also include a second plate having a hole corresponding to the drain hole in the flexible, fluid impermeable container. The flexible, fluid impermeable container is provided between a bottom surface of the first plate and a top surface of the second plate. The first and second plates and the flexible, fluid impermeable container are attached to maintain the flexible, fluid impermeable container therebetween with the holes of the first and second plates and the drain hole aligned.

In one form, the plurality of vertically extending leg members are connected to the first plate of the rigid valve member and are horizontally adjustable relative thereto to fit the catch basin into different size storm drains.

In another form, the rigid valve member further includes a cover movable between a closed position where the cover sealingly contacts the vertical wall opening prohibiting the flow of liquids through the drain hole and an open position where the cover is moved away from the vertical wall opening permitting the flow of liquids through the drain hole. Movement of the cover may be accomplished via a variety of methods, including, but not limited to, manually, mechanically, electrically and hydraulically.

In a preferred form, the rigid valve member includes a threaded shaft with a first end having a non-circular cross-section. The cover includes at least one anti-rotational surface and a threaded hole engaging the threaded shaft. The at least one anti-rotational surface on the cover engages an anti-rotational channel formed in the rigid valve member such that the cover moves along the threaded shaft between the open and closed positions when the threaded shaft is rotated. A handle is provided which is configured to fit through the preexisting, perforated storm drain cover, and includes an engaging end configured for keyed engagement with the first end of the threaded shaft for rotation of the threaded shaft. Preferably, the handle includes a T-shaped handle.

The catch basin may further include first and second support members extending vertically from the first plate on opposite sides of the vertically extending wall and having facing anti-rotational channels, and a shaft support member attached to the first and second support members and extending across the vertical wall opening. The threaded shaft is connected to the shaft support member for rotational movement relative thereto, with the at least one anti-rotational surface of the cover including at least one radially extending tab received in one of the facing anti-rotational channels, such that the cover moves along the threaded shaft between the open and closed positions when the threaded shaft is rotated.

Preferably, the flexible, fluid impermeable container is made of a urethane-covered woven polyester. The rigid valve member and the plurality of leg members are preferably made of a powder coated steel.

It is an object of the present invention to provide a catch basis for a storm drain which is adjustable to fit various size storm drains.

It is a further object of the present invention to provide a catch basin for a storm drain for selectively controlling the flow of liquid through the storm drain without having to remove the storm drain cover.

It is still a further object of the present invention to provide a catch basin for a storm drain for prohibiting the flow of trash and other debris through the storm drain, while not impeding the ability of the catch basin to prohibit the flow of liquids or other viscous materials through the storm drain.

It is yet a further object of the present invention to provide a catch basin for a storm drain which allows time for heavy solids and other debris that could clog the drain to settle out.

It is an even further object of the present invention to provide a catch basin for a storm drain which delays the entry of liquid into the storm drain providing a time frame within which the catch basin may be closed to substantially prohibit the flow of liquid, such as a hazardous material, into the storm drain in the event of an emergency spill situation.

Other aspects, objects and advantages of the present invention can be obtained from a study of the application, the drawings, and the appended claims.

DETAILED DESCRIPTION OF THE INVENTION

Figure 1:
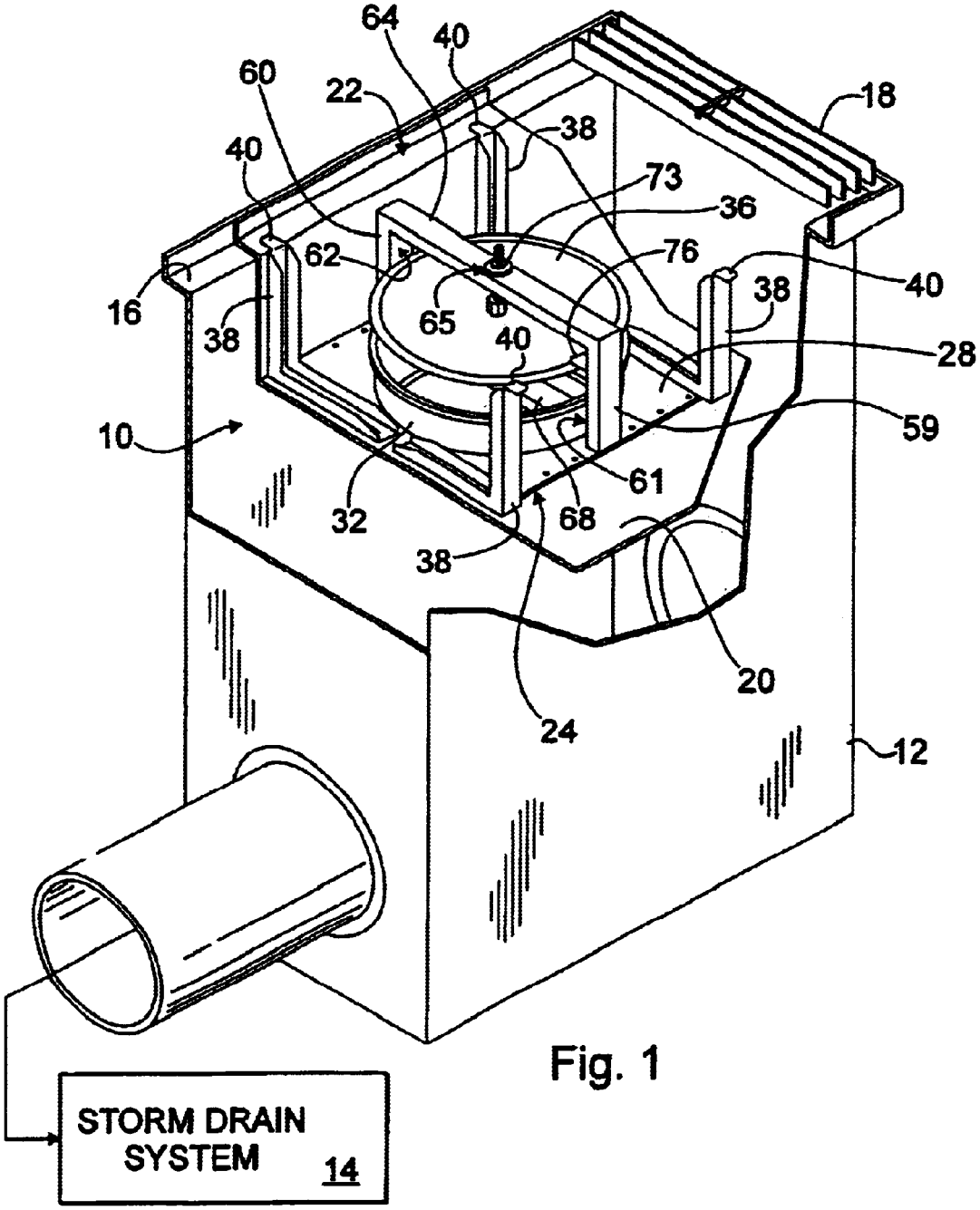
FIG. 1 is a perspective view of a catch basin according to the present invention installed within a storm drain.

Referring to FIG. 1, a catch basin, shown generally at 10, according to the present invention is illustrated disposed in a pre-existing storm drain 12, which is typically connected to a storm drain system 14. The storm drain 12 will typically be disposed below ground level, and includes a shoulder 16 around its upper periphery for supporting a pre-existing, perforated storm drain cover 18. The perforated storm drain cover 18 permits individuals and vehicles to travel unimpeded across the storm drain 12, while still permitting the storm drain 12 to collect flowing liquids and other viscous materials. Preferably, the storm drain 12 is situated in such a place so that gravitational forces draw the liquid, in most instances rain water, into the storm drain 12.

The catch basin 10 includes a fluid impermeable container 20 extending into the storm drain 12, with the edges 22 of the fluid impermeable container 20 extending over the shoulder 16 of the storm drain 12 about the periphery thereof. The fluid impermeable container 20 collects all viscous materials flowing into the storm drain 12. A sealant (not shown) is typically provided between the edges of the fluid impermeable container 20 and the storm drain shoulder 16 to effectuate a water-tight seal therebetween. A valve member, shown generally at 24, is provided to selectively permit viscous materials collected by the fluid impermeable container 20 in the storm drain 12 to pass to the storm drain system 14.

Figure 2:
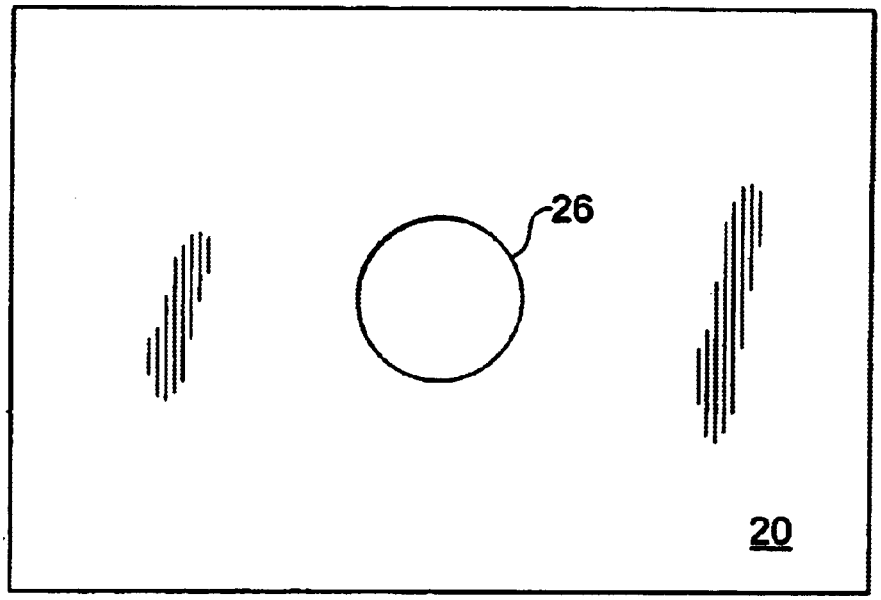
FIG. 2 is a top view of a flexible, fluid impermeable container according to the present invention.
Figure 3:
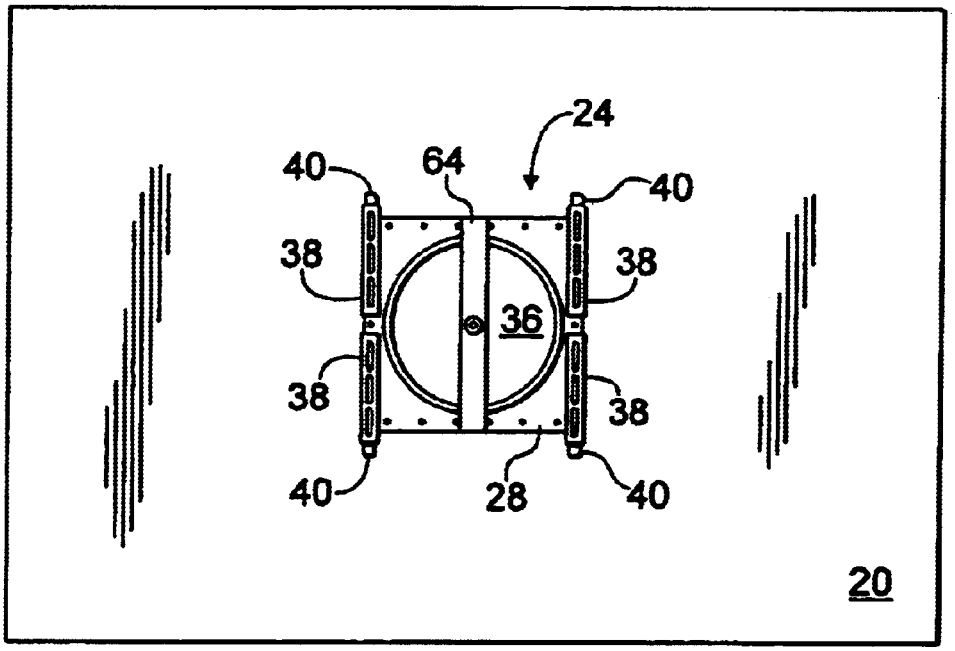
FIG. 3 is a top view of the catch basin according to the present invention.

As shown in FIG. 2, the fluid impermeable container 20 includes a flexible, liquid impermeable apron, or sheet, having a drain hole 26 provided therethrough. In a preferred form, the fluid impermeable container 20 includes a rectangular sheet of urethane-coated woven polyester, approximately 5'×7' in size. However, the fluid impermeable container 20 may be made to any size and of any material having appropriate fluid impermeability characteristics and strength without departing from the spirit and scope of the present invention. As shown in FIG. 3, the valve member 24 is attached to the fluid impermeable container in alignment with the drain hole 26 to selectively open and close the drain hole 26 to control the flow of viscous material entering the storm drain 12 to the storm drain system 14.

Figure 4:
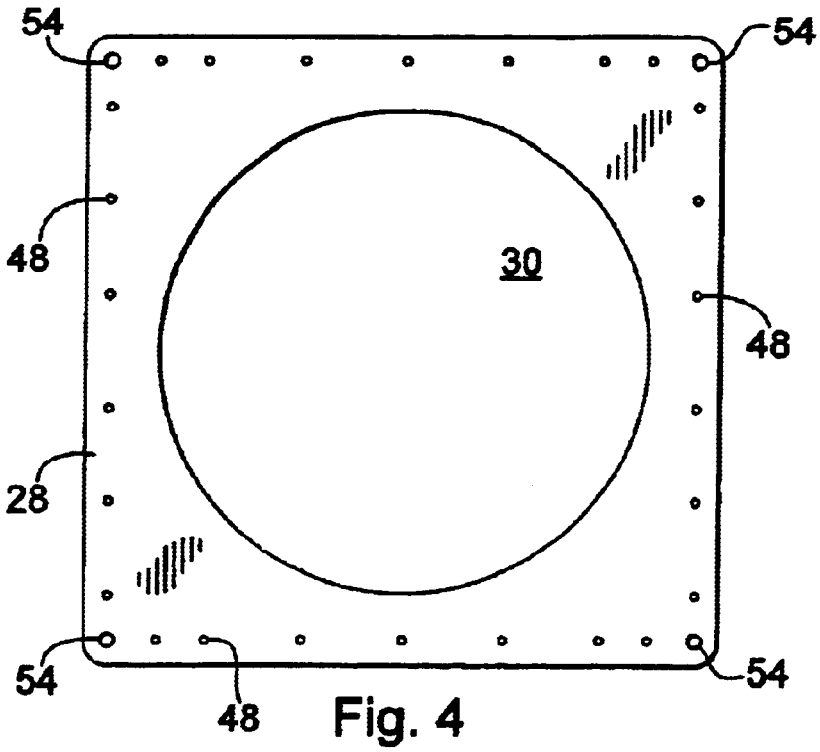
FIG. 4 is a top view of a first plate according to the present invention.

Referring to FIG. 1, the valve assembly 24 is typically made of a rigid material, such as powder coated steel (formed steel), however, the valve assembly 24 may be made from any material of sufficient strength and rigidity, such as, but not limited to, cast steel, cast aluminum, aluminum, plastic, stainless steel, rubber, etc. The valve assembly 24 includes a first plate 28 attached to the fluid impermeable container 20, the first plate 28 having a hole 30 (see FIG. 4) corresponding and aligned with the drain hole 26. A vertically extending wall 32 extends from a top surface of the first plate 28 surrounding the hole 30 therein, and thus also the drain hole 26 aligned therewith. The vertically extending wall 32 extends upward from the first plate 28 a distance h terminating at a flanged periphery 33 defining an opening 34 (see FIG. 5). A cover 36 is provided, generally conforming to the shape of the vertically extending wall 32. The cover 36 is movable between an open position, as shown in FIG. 1, where the cover 36 is moved away from the vertical wall opening 34 permitting the flow of viscous material through the vertical wall opening 34 and thus the drain hole 26 and into the storm drain system 14, and a closed position where the cover 36 engages the vertically extending wall 32 at the flanged periphery 33, thus closing the vertical wall opening 34 and prohibiting the flow of viscous material therethrough.

Figure 5:
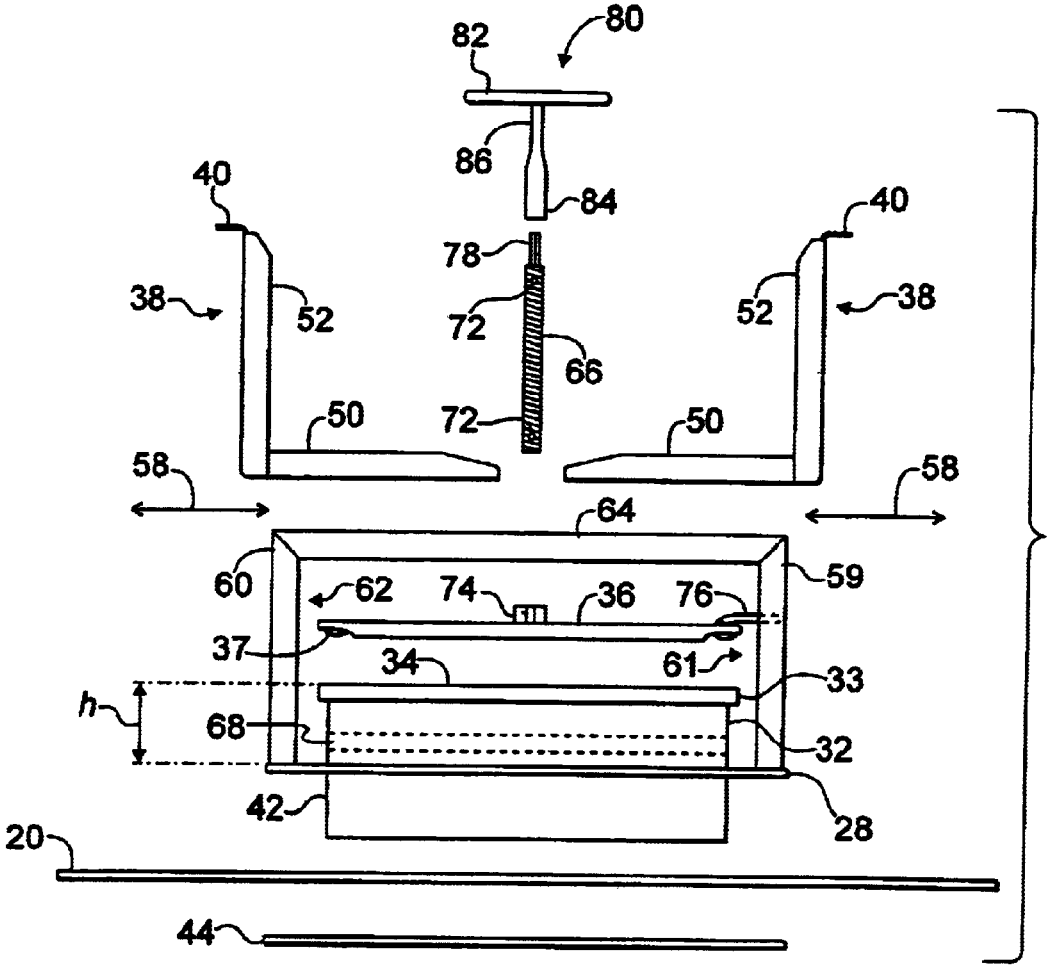
FIG. 5 is an exploded assembly view of the catch basin according to the present invention.

As shown in FIG. 5, the cover 36 includes a rubber gasket 37 about its periphery on an underside thereof which engages the flange 33 of the vertically extending wall to provide a fluid-tight seal therebetween with the cover 36 in the closed position.

Four vertically extending leg members 38 are attached to the first plate 28, with each leg member 38 including a horizontally extending flange 40 for engaging the storm drain shoulder 16 on top of the flexible, fluid impermeable container edge 22 to maintain the catch basin within the storm drain 12. With the catch basin 10 in place in the storm drain 12, the perforated storm drain cover 18 rests on the storm drain shoulder 16 on top of the flanges 40 and edge 22 of the fluid impermeable container 20.

Figure 6:
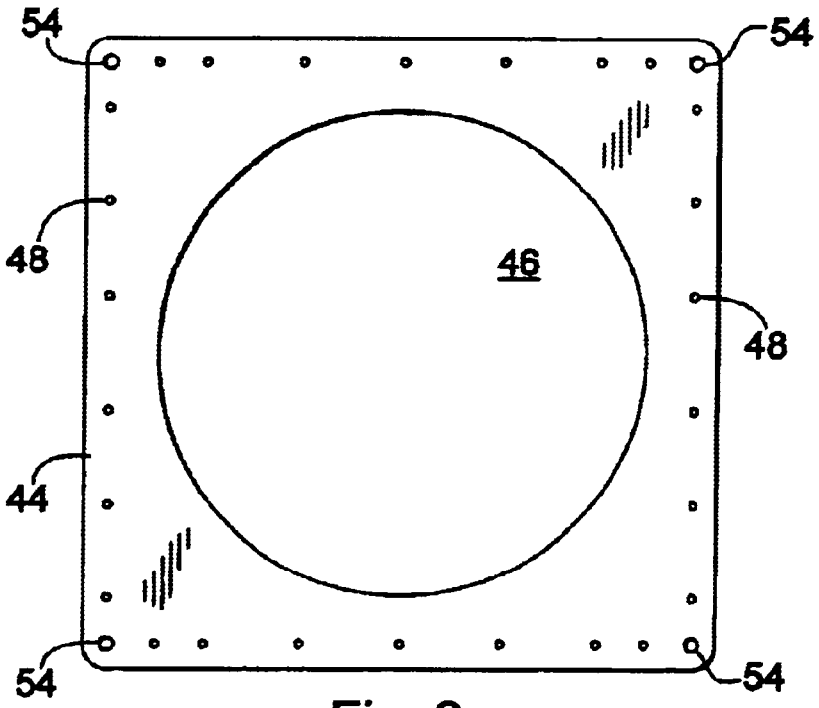
FIG. 6 is a top view of a second plate according to the present invention.

Referring to FIGS. 5–11, assembly of the catch basin 10 is as follows. The hole 30 in the first plate 28 is aligned with the drain hole 26 in the fluid impermeable container 20. To facilitate such alignment, the vertically extending wall 32 includes downward extending portion 42 extending below the first plate 28. The downward extending portion 42 is inserted in the drain hole 26, and a second plate 44 is attached to the first plate 28 to maintain the fluid impermeable container 20 therebetween. As shown in FIG. 6, the second plate 44 includes a hole 46 therethrough into which the downward extending portion 42 is received for alignment purposes. The first 28 and second 44 plates are attached via conventional fasteners extending through apertures 48 formed in each of the first 28 and second 44 plates, such that a top surface of the second plate 44 abuts a bottom surface of the first plate 28 with the fluid impermeable container 20 maintained therebetween. A sealant (not shown) is provided between the first plate 28, the fluid impermeable container 20 and the second plate 44 to provide a fluid-tight connection there between.

The vertically extending wall 32 and downward extending portion 42 and typically welded to the first plate 28, although other means of attachment may be utilized without departing from the spirit and scope of the present invention. Further, spot welds (not shown) may be utilized to reinforce the connection between the first 28 and second 44 plates.

Figure 7:
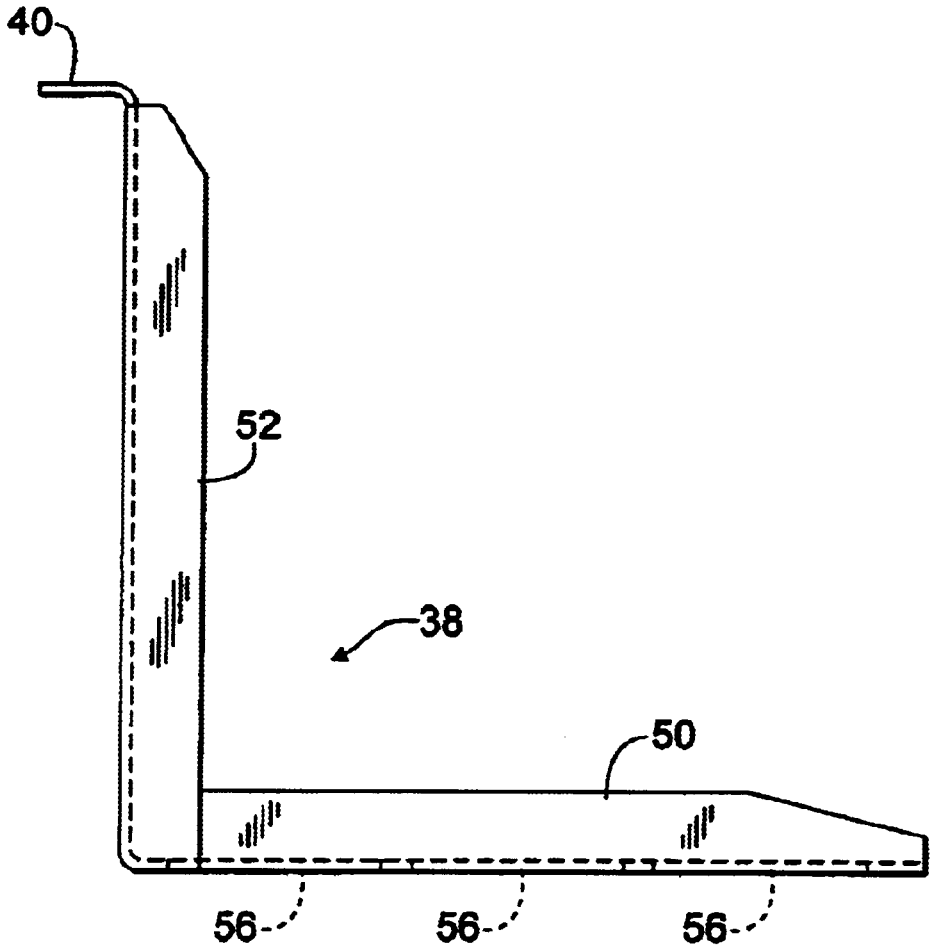
FIG. 7 is a side view of a vertically extending leg member for mounting the catch basin in a storm drain.
Figure 8:
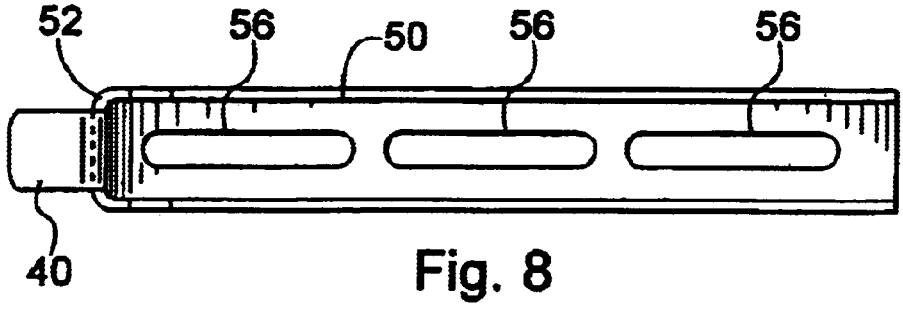
FIG. 8 is a top elevational view of the vertically extending leg member of FIG. 7.
Figure 9:
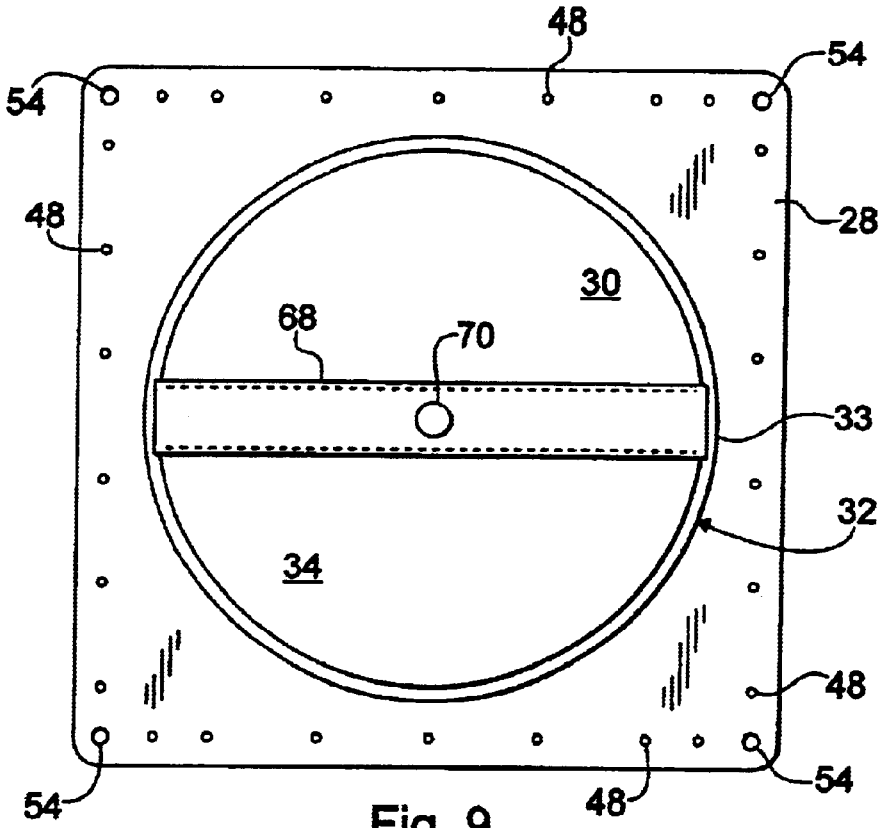
FIG. 9 is a top view of the first plate, vertically extending wall and bottom shaft support member according to the present invention.

The vertically extending leg members 38 include L-shaped leg members having horizontal 50 and vertical 52 members, each having a U-shaped cross-section, with the horizontally extending flange 40 extending from the vertical member 52. The vertically extending leg members 38 are attached to the first plate 28 at their horizontal members 50 via conventional fasteners extending through the horizontal members 50 and apertures 54 formed at the corners of each of the first 28 and second 44 plates. As shown in FIGS. 7–8, the horizontal members 50 include slots 56 formed therein, permitting the vertically extending leg members 38 to be horizontally adjustable relative to the first plate 28. The fasteners (not shown) connecting the vertical leg members 38 to the first plate 28 will have a shaft diameter smaller than the slot 56, but a head portion diameter greater than the slot 56. Thus, loosening the fastener will allow the vertically extending leg member 38 to be horizontally adjusted in the direction of arrows 58 (see FIG. 5) relative to the first plate 28. Also, to facilitate such adjustment, the head diameters of the fasteners (not shown) connecting the first 28 and second 44 plates will be smaller than the slots 56. In this manner, the catch basin 10 may be utilized in a variety of different size storm drains.

To facilitate movement of the cover 36 between the open and closed positions, first and second support members 59 and 60 extend vertically from the first plate 28 on opposite sides of the vertically extending wall 32. Each of the first 59 and second 60 support members have U-shaped cross-sections defining first and second anti-rotational channels 61 and 62 facing one another. A top shaft support member 64 is connected between the first 60 and second 62 support members, and extends across the vertical wall opening 34. The top shaft support member 64 includes an opening 65 for receiving a threaded shaft 66. A bottom shaft support member 68 (see FIG. 9) is connected to the interior surface of the vertically extending wall 32, also extending across the vertical wall opening. The bottom shaft support member 68 includes a shaft receiving hole 70 aligned with the shaft receiving hole 65 in the top shaft support member 64. The shaft 66 is received in the holes 65 and 70 provided in the top shaft support member 64 and the bottom shaft support member 68 and is retained therein by shaft retaining pins (not shown) received in shaft retaining apertures 72 formed in the shaft 66 at opposite ends. Typically, to facilitate smooth operation, washers 73 are provided between the retaining pins and the respective shaft support member for ease of rotation of the shaft 66. While the various connections of members 60, 62, 64 and 68 are preferably effectuated by welding, other connection means are contemplated.

The cover 36 includes a hex nut 74 welded thereto in alignment with an aperture formed in the cover 36. The threaded shaft 66 is threaded onto the cover 36 via the internal threads of the hex nut 74. The cover 36 also includes an anti-rotational surface defined by a radially extending tab 76 welded thereto and received in the channel 61 formed by the first support member 59. The radially extending tab 76 engages the channel 61 in the first support member 60 to prevent rotation of the cover 36. When the shaft 66 is rotated, the cover 36, which is prevented from rotating by the radially extending tab 76, moves along the shaft 66. The shaft 66 may thus be rotated to move the cover 36 into and out of engagement with the vertically extending wall 32 between the open and closed positions.

Figure 10:
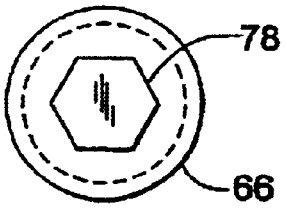
FIG. 10 is a top view of the shaft of FIG. 5.
Figure 11:
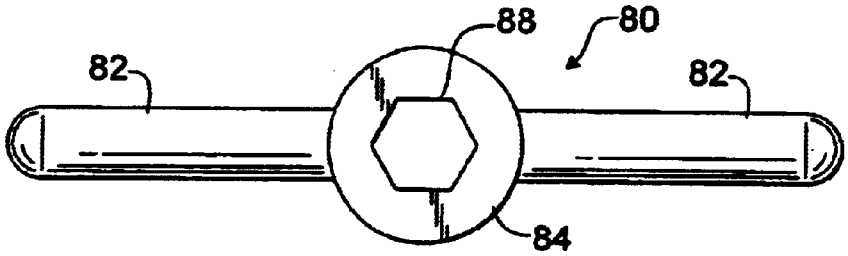
FIG. 11 is a bottom view of the handle shown in FIG. 5.

To facilitate rotation of the shaft 66, the shaft 66 includes a first end 78 having a non-circular cross section. As shown in FIG. 10, the non-circular cross section is preferably hex-shaped. A handle 80 includes a handle portion 82 connected to an engagement end 84 by a shaft 86. The engagement end 84 includes a corresponding non-circular receptacle 88 which engages the first end 78 to facilitate rotation of the shaft 66. The handle 80 is preferably a T-shaped handle which may fit through the perforations in the perforated storm drain cover, and as shown in FIG. 11, includes a correspondingly hex-shaped receptacle 88. In operation, the engagement end 84 and shaft 86 of the handle 80 may be fit through the perforations in the perforated storm drain cover 18 to engage the first end 78 of the shaft 66, with the handle portion 82 remaining outside of the storm drain 12. Thus, a user may open and close the catch basin 10 according to the present invention without having to remove the perforated cover 18 from the storm drain 12.

The inventive catch basin 10 described herein has the advantage that it may be fit into storm drains of varying sizes. After measuring the storm drain opening, the flexible, fluid impermeable container 20 may be cut to fit the storm drain 12, such that the edges 22 thereof lie on the shoulder 16 of the storm drain 12. The vertically extending legs 38 may be adjusted such that the horizontally extending flanges of each leg 38 lie on the shoulder 16 of the storm drain 12 on top of the edge 22 of the flexible, fluid impermeable container 20. Adjustment of the catch basin 10 may also be needed to ensure that the shaft 66 is aligned with a perforation, or opening, in the drain cover 18, such that the T-shaped handle 80 may easily extend through the perforated storm drain cover 18 and engage the shaft 66 for opening and closing the catch basin 10. To ensure a fluid-tight seal, sealant is typically provided between the edges 22 of the flexible, fluid impermeable cover 10 and the shoulder 16 of the storm drain 12.

By providing the vertically extending wall 32 that extends vertically a distance h from the first plate 28, with the catch basin 10 in an open position, liquids, and other viscous materials accumulating in the catch basin 10 will be precluded from emptying through the drain hole 26 and into the storm drain system 14 until the liquid rises to a level exceeding the height h of the vertically extending wall 32. Thus, trash, heavy solids and other debris that may fall into the storm drain 12 are prevented from entering the storm drain system 14, and are also prevented from impeding the opening and closing of the catch basin 10. Further, in the event of an emergency spill situation, a safety window is thus provided to help further ensure that any hazardous materials do not flow into the storm drain system 14. Even with the catch basin 10 in an open position, viscous material will not flow into the storm drain system 14 until rising to a level exceeding the height h of the vertically extending wall 32. Thus, an individual responding to an emergency spill situation has time, corresponding to the time it takes the fluid to rise to a level exceeding the height h, to close the catch basin 10 and prohibit hazardous material from flowing into the storm drain system 14. Since the only tool required to close the catch basin 10 is the relatively small handle 80, it can typically be placed in a location where it can be quickly and conveniently accessed to close the catch basin 10. Once closed, the catch basin 10 should remain closed until such time as the spill has been properly cleaned up.

While the inventive catch basin 10 has been described herein as configured for manual opening and closing thereof, the present invention is in no way limited to such manual actuation. Other methods of opening and closing the catch basin 10 may be implemented, such as, but not limited to, mechanical, electrical and hydraulic actuation, without departing from the spirit and scope of the present invention.

While the present invention has been described with the particular reference to the drawings, it should be understood the various modifications could be made without departing from the spirit and scope of the present invention.

We claim:

1. A catch basin constructed for insertion into a pre-existing storm drain connected to a storm drain system for selectively controlling the flow of liquids into the storm drain system, the storm drain having a shoulder around its upper periphery for supporting a pre-existing, perforated storm drain cover, said catch basin comprising:

a flexible, fluid impermeable container extendable into the storm drain and having edges extendable over the storm drain shoulder about the periphery thereof, the fluid impermeable container having a drain hole; and a valve member attached to the fluid impermeable container and configured to selectively open and close the drain hole, the valve member including a vertically extending wall surrounding the drain hole and extending upward therefrom a distance h to define an opening, and a cover movable between a closed position where the cover sealingly contacts the vertical wall opening prohibiting the flow of liquids through the drain hole and an open position where the cover is moved away from the vertical wall opening permitting the flow of liquids through the drain hole, wherein with the cover in the open position, liquid accumulating in the fluid impermeable container will not pass through the drain hole until the liquid rises to a level exceeding the height h of the vertically extending wall surrounding the drain hole.

2. The catch basin of claim 1, further comprising a handle configured to fit through the pre-existing, perforated storm drain cover and operably engage the valve member to move the cover between the open and closed positions.

3. A catch basin constructed for insertion into a pre-existing storm drain connected to a storm drain system for selectively controlling the flow of liquids into the storm drain system, the storm drain having a shoulder around its upper periphery for supporting a pre-existing, perforated storm drain cover, said catch basin comprising:

a fluid impermeable container extendable into the storm drain and having edges extendable over the storm drain shoulder about the periphery thereof, the fluid impermeable container having a drain hole;

a valve member attached to the fluid impermeable container and configured to selectively open and close the drain hole, the valve member including a vertically extending wall surrounding the drain hole and extending upward therefrom a distance h to define an opening, and a cover movable between a closed position where the cover sealingly contacts the vertical wall opening prohibiting the flow of liquids through the drain hole and an open position where the cover is moved away from the vertical wall opening permitting the flow of liquids through the drain hole, wherein with the cover in the open position, liquid accumulating in the fluid impermeable container will not pass through the drain hole until the liquid rises to a level exceeding the height h of the vertically extending wall surrounding the drain hole; and a plurality of vertically extending leg members attached to the valve member, each of the plurality of vertically extending leg members having a horizontally extending flange engagable with the storm drain shoulder on top of the fluid impermeable container for supporting the catch basin within the storm drain.

4. The catch basin of claim 3, wherein the plurality of vertically extending leg members are horizontally adjustable to fit the catch basin into different size storm drains.

5. A catch basin constructed for insertion into a pre-existing storm drain connected to a storm drain system for selectively controlling the flow of liquids into the storm drain system, the storm drain having a shoulder around its upper periphery for supporting a pre-existing, perforated storm drain cover, said catch basin comprising:

a flexible, fluid impermeable container extendable into the storm drain and having edges extendable over the storm drain shoulder about the periphery thereof, the flexible, fluid impermeable container having a drain hole;

a rigid valve member attached to the flexible, fluid impermeable container and configured to selectively open and close the drain hole, the rigid valve member including a vertically extending wall surrounding the drain hole and extending upward therefrom a distance h to define an opening, wherein with the drain hole open, liquid accumulating in the flexible, fluid impermeable container will not pass through the drain hole until the liquid rises to a level exceeding the height h of the vertically extending wall surrounding the drain hole; and a plurality of vertically extending leg members attached to the rigid valve member, each of the plurality of vertically extending leg members having a horizontally extending flange engagable with the storm drain shoulder on top of the flexible, fluid impermeable container for supporting the catch basin within the storm drain.

6. The catch basin of claim 5, wherein the flexible, fluid impermeable container is made of urethane-coated woven polyester.

7. The catch basin of claim 5, wherein the rigid valve member includes a first plate having a hole corresponding to the drain hole in the flexible, fluid impermeable container, the vertically extending wall extending from a top surface of the first plate and surrounding the hole therein, the flexible, fluid impermeable container attached to the first plate such that the drain hole and the hole in the first plate are aligned.

8. The catch basin of claim 7, wherein the rigid valve member includes a second plate having a hole corresponding to the drain hole in the flexible, fluid impermeable container, wherein the flexible, fluid impermeable container is disposed between the first and second plates, with the first and second plates and the flexible, fluid impermeable container attached to maintain the flexible, fluid impermeable container therebetween with the holes in the first and second plates and the drain hole aligned.

9. The catch basin of claim 8, wherein a bottom surface of the first plate engages a top surface of the flexible, fluid impermeable container and a top surface of the second plate engages a bottom surface of the flexible, fluid impermeable container and wherein the first and second plates and the flexible, fluid impermeable container are attached to maintain the flexible, fluid impermeable container therebetween with the holes of the first and second plates and the drain hole aligned.

10. The catch basin of claim 5, wherein the plurality of vertically extending leg members are horizontally adjustable to fit the catch basin into different size storm drains.

11. The catch basin of claim 5, wherein the rigid valve member includes a cover movable between a closed position where the cover sealingly contacts the vertical wall opening prohibiting the flow of liquids through the drain hole and an open position where the cover is moved away from the vertical wall opening permitting the flow of liquids through the drain hole, wherein with the cover in the open position, liquid accumulating in the fluid impermeable container will not pass through the drain hole until the liquid rises to a level exceeding the height h of the vertically extending wall surrounding the drain hole.

12. The catch basin of claim 11, wherein the rigid valve member includes a threaded shaft, and wherein the cover includes at least one anti-rotational surface and a threaded hole, the at least one anti-rotational surface engaging an at least one anti-rotational channel formed in the rigid valve member and the threaded hole engaging the threaded shaft, such that the cover moves along the threaded shaft between the open and closed positions when the threaded shaft is rotated.

13. The catch basin of claim 12, wherein the threaded shaft includes a first end having a non-circular cross-section, the catch basin further comprising a handle configured to fit through the pre-existing, perforated storm drain cover and having an engaging end configured for keyed engagement with the first end of the threaded shaft for rotation of the threaded shaft.

14. The catch basin of claim 13, wherein the handle comprises a T-shaped handle.

15. A catch basin constructed for insertion into a pre-existing storm drain connected to a storm drain system for selectively controlling the flow of liquids into the storm drain system, the storm drain having a shoulder around its upper periphery for supporting a pre-existing, perforated storm drain cover, said catch basin comprising:

a flexible, fluid impermeable container extendable into the storm drain and having edges extendable over the storm drain shoulder about the periphery thereof, the flexible, fluid impermeable container having a drain hole;

a rigid valve member attached to the flexible, fluid impermeable container and configured to selectively open and close the drain hole, the rigid valve member comprising:

a first plate having a hole corresponding to the drain hole in the flexible, fluid impermeable container;

a vertically extending wall extending from a top surface of the first plate and surrounding the hole therein and extending upward therefrom a distance h to define an opening, the flexible fluid impermeable container attached to the first plate such that the drain hole and the hole in the first plate are aligned, wherein with the drain hole open, liquid accumulating in the flexible, fluid impermeable container will not pass through the drain hole until the liquid rises to a level exceeding the height h of the vertically extending wall surrounding the drain hole; and a cover movable between a closed position where the cover sealingly contacts the vertical wall opening prohibiting the flow of liquids through the drain hole and an open position where the cover is moved away from the vertical wall opening permitting the flow of liquids through the drain hole; and a plurality of vertically extending leg members having a horizontally extending flange engagable with the storm drain shoulder on top of the flexible, fluid impermeable container for supporting the catch basin within the storm drain.

16. The catch basin of claim 15, wherein the rigid valve member includes a threaded shaft, and wherein the cover includes at least one anti-rotational surface and a threaded hole, the at least one anti-rotational surface engaging an at least one anti-rotational channel formed in the rigid valve member and the threaded hole engaging the threaded shaft, such that the cover moves along the threaded shaft between the open and closed positions when the threaded shaft is rotated.

17. The catch basin of claim 16, wherein the rigid valve member includes first and second support members extending vertically from the first plate on opposite sides of the vertically extending wall, the first and second support members including facing anti-rotational channels, and a shaft support member attached to the first and second support members and extending across the vertical wall opening, the threaded shaft connected to the shaft support member for rotational movement relative thereto, and wherein the at least one anti-rotational surface of the cover includes at least one radially extending tab received in at least one of the facing anti-rotational channels, such that the cover moves along the threaded shaft between the open and closed positions when the threaded shaft is rotated.

18. The catch basin of claim 16, wherein the threaded shaft includes a first end having a non-circular cross-section, the catch basin further comprising a handle configured to fit through the pre-existing, perforated storm drain cover and having an engaging end configured for keyed engagement with the first end of the threaded shaft for rotation of the threaded shaft.

19. The catch basin of claim 18, wherein the handle comprises a T-shaped handle.

20. The catch basin of claim 15, wherein the plurality of vertically extending leg members are horizontally adjustable relative to the first plate to fit the catch basin into different size storm drains.

21. The catch basin of claim 15, wherein the flexible, fluid impermeable container is made of urethane-coated woven polyester.

22. The catch basin of claim 5, wherein the rigid valve member and the plurality of leg members are made of powder coated steel.

23. A catch basin constructed for insertion into a pre-existing storm drain connected to a storm drain system for selectively controlling the flow of liquids into the storm drain system, the storm drain having a shoulder around its upper periphery for supporting a pre-existing, perforated storm drain cover, said catch basin comprising:

a unitary, fluid impermeable container extendable into the storm drain and having edges extendable over the storm drain shoulder about the periphery thereof, the fluid impermeable container having a drain hole; and a valve member attached to the fluid impermeable container and configured to selectively open and close the drain hole, the valve member including a vertically extending wall surrounding the drain hole and extending upward therefrom a distance h to define an opening, and a cover movable between a closed position where the cover sealingly contacts the vertical wall opening prohibiting the flow of liquids through the drain hole and an open position where the cover is moved away from the vertical wall opening permitting the flow of liquids through the drain hole, wherein with the cover in the open position, liquid accumulating in the fluid impermeable container will not pass through the drain hole until the liquid rises to a level exceeding the height h of the vertically extending wall surrounding the drain hole.

* * * * *